US011199316B1

(12) United States Patent
Rajasekaran

(10) Patent No.: US 11,199,316 B1
(45) Date of Patent: Dec. 14, 2021

(54) FLEXIBLE LIGHT

(71) Applicant: E. MISHAN & SONS, INC., New York, NY (US)

(72) Inventor: Mohan Rajasekaran, Watertown, CT (US)

(73) Assignee: E. MISHAN & SONS, INC., New York, NY (US)

( * ) Notice: Subject to any disclaimer, the term of this patent is extended or adjusted under 35 U.S.C. 154(b) by 0 days.

(21) Appl. No.: 17/246,942

(22) Filed: May 3, 2021

Related U.S. Application Data

(63) Continuation of application No. 17/089,051, filed on Nov. 4, 2020, now Pat. No. 11,035,559, which is a continuation of application No. 29/741,070, filed on Jul. 9, 2020, now Pat. No. Des. 917,089.

(51) Int. Cl.

| | |
|---|---|
| ***F21V 21/30*** | (2006.01) |
| ***F21S 2/00*** | (2016.01) |
| ***F21K 9/232*** | (2016.01) |
| *F21Y 115/10* | (2016.01) |

(52) U.S. Cl.
CPC ..... *F21V 21/30* (2013.01); *F21K 9/232* (2016.08); *F21S 2/005* (2013.01); *F21Y 2115/10* (2016.08)

(58) Field of Classification Search
CPC ..... F21V 21/30; F21K 9/232; F21S 2/005; F21Y 2115/10
See application file for complete search history.

(56) References Cited

U.S. PATENT DOCUMENTS

| | | | |
|---|---|---|---|
| 7,131,753 | B1 | 11/2006 | Edwards, Jr. |
| 7,407,304 | B2 | 8/2008 | Tasson et al. |
| D578,695 | S | 10/2008 | Zheng et al. |
| D578,696 | S | 10/2008 | Wang et al. |
| 7,556,398 | B2 | 7/2009 | Van Der Poel |
| 7,980,738 | B2 | 7/2011 | Chiang |
| 8,047,682 | B2 | 11/2011 | Zheng et al. |
| 8,072,123 | B1 | 12/2011 | Han |
| 8,092,047 | B2 | 1/2012 | Ma et al. |
| 8,109,660 | B2 | 2/2012 | Hochstein et al. |
| 8,534,884 | B2 | 9/2013 | Lui |
| 8,845,132 | B2 | 9/2014 | Flaherty et al. |
| 8,882,297 | B2 | 11/2014 | Flaherty et al. |
| 9,328,911 | B2 | 5/2016 | Chen et al. |
| 9,732,951 | B2 | 8/2017 | Guercio et al. |
| 9,897,302 | B2 | 2/2018 | Flaherty et al. |
| 9,951,931 | B1 | 4/2018 | Lan |
| 9,951,939 | B1 | 4/2018 | Lan |
| 10,161,575 | B2 | 12/2018 | Xiong et al. |
| 10,274,172 | B1 | 4/2019 | Chiu et al. |
| D861,926 | S | 10/2019 | Lin |
| 2004/0114367 | A1 | 6/2004 | Li |
| 2011/0051434 | A1 | 3/2011 | Lin |
| 2011/0170288 | A1 | 7/2011 | Kim |
| 2014/0307431 | A1 | 10/2014 | Santashev et al. |
| 2017/0299151 | A1 | 10/2017 | Luo |
| 2018/0010776 | A1 | 1/2018 | Shim |

*Primary Examiner* — Anabel Ton
(74) *Attorney, Agent, or Firm* — Notaro, Michalos & Zaccaria P.C.

(57) ABSTRACT

A lighting apparatus includes a main body, the main body comprising a top, a bottom, a plurality of sides. The apparatus includes light source support wings, each of the light source support wings being hingedly connected to the main body. The light source support wings are adapted to support light emitting devices. When the respective light source support wings are extended in the same plane from the main body, the light source support wings form an overall geometric shape.

10 Claims, 16 Drawing Sheets

FLEXIBLE LIGHT

CROSS-REFERENCE TO RELATED APPLICATIONS

This application is a continuation of U.S. patent application Ser. No. 17/089,051 filed Nov. 4, 2020, now U.S. Pat. No. 11,035,559, which is a continuation of of U.S. patent application Ser. No. 29/741,070, filed on Jul. 9, 2020, now U.S. Pat. No. D917,089, the entire disclosures of which are incorporated herein by reference herein.

FIELD AND BACKGROUND OF THE INVENTION

The present disclosure relates generally lighting apparatuses, and more particularly to apparatuses for the production of different light distribution patterns.

Light fixtures are provided for a wide variety of applications, including both interior and exterior applications. Even among interior and exterior uses, there are a variety of different lighting requirements, depending on where the light fixture will be installed and the intended use. Thus, light fixtures are designed and manufactured with specific purposes in mind, including providing utility, security, safety, and/or aesthetics. As should be appreciated, there are high costs associated with producing a variety of unique light fixtures, each specifically customized for a specific use and to provide a specific, lighting effect.

There is a continuing need to reduce manufacturing costs and improve efficiency and effectiveness of both the manufacturing process and the resulting products. The incorporation, or use, of LEDs in both interior and exterior light fixtures is one example of the growing trend to improve efficiency. In particular, LEDs consume less energy and last longer than traditional fluorescent and incandescent light sources. Additional means for improving efficiency and effectiveness in the lighting industry are also needed. In particular, the LED lamps, have limited usage for illumination due to their narrow viewing angles and heating problems. Therefore, there is a need to develop an LED lamps that obviate these problems.

The present invention is directed to such an effort.

SUMMARY OF THE INVENTION

Accordingly, an object of the present invention is to provide a multi-source lighting device which integrates heat dissipation, making light area of spotlights overlapped and adjusting focus spots of the spotlights in a light field.

In one embodiment, a plurality of arm assemblies can be provided around a center housing or hub, each directed outwardly in a radial direction from a central point or axis of the center housing or hub. Each arm's source housing structure can be located to project light either downwardly, outwardly or downwardly and outwardly and can be angled at a plurality of angular adjustment positions with respect to the center housing in each of the positions. In an illustrative embodiment, the light sources can be LED bulbs arranged in a plurality of configurations.

Embodiments of the present disclosure provide an illumination apparatus capable of increasing the efficiency of heat dissipation for heat generated in the light modules. Further, certain exemplary embodiments may provide an illumination apparatus capable of adjusting light uniformity by varying an illumination angle of light generated from each of the plurality of light modules. The present invention provides a multi-purpose illumination apparatus. Moreover, embodiments provide an illumination apparatus that permits replacement of only the malfunctioning light modules among a plurality of light modules, thereby reducing the maintenance cost.

One exemplary aspect may provide an illumination apparatus, which includes: a main body having a top, a bottom, and plurality of sides, a socket connection prong protruding from the top of the main body.

In one aspect of the invention, the main body defines an inner space for receiving circuitry.

In another aspect of the invention the socket connection prong is adapted for communication, for example threaded communication, with an electrical socket. The socket connection prong is further adapted for electrically communicating with the circuitry disposed within the main body, for example, via wire.

In another aspect of the invention, the main body including a plurality of wire communicating openings disposed along the perimeter of the main body, the wire communicating openings being equally distanced.

In another aspect of the invention, the wire communicating openings are located on every second side of the main body.

In another aspect of the invention, the wire communicating openings are located on each side of the main body.

In one another aspect of the invention, the illumination apparatus includes a plurality of wires, each of the plurality of wires passing through an insulating sleeve, each wire having a first end and a second end, each of the plurality of wire sleeves passing through a respective one of the wire communicating openings, the first end of each of the plurality of wires being in electrical communication with the circuitry, the second end of each of the plurality of wires being in electrical communication with at least one light emitting device. In preferred embodiments, grommets are provided in the wire communication openings, the wire sleeves passing through the grommets.

In another aspect of the invention, a plurality of body hinge portions are disposed around a perimeter of the main body, the body hinge portions being equally distanced.

In another aspect of the invention, the body hinge portions are located on every second side of the main body.

In another aspect of the invention, the body hinge portions are located on each side of the main body.

In another aspect of the invention, the apparatus includes four light source support wings, each of the light source support wings having a wing hinge portion on one end thereof, each of the light source support wings being hingedly connected to the main body by alignment of its wing hinge portion with a respective one of the body hinge portions, the respective the body hinge portions each comprising at least one body hinge knuckle which defines an opening and the respective wing hinge portions each comprising at least one wing hinge knuckle which defines an opening, the respective body hinge knuckles and wing hinge knuckles being aligned and alternating, a pin passing through the respective openings defined by the aligned, alternating wing hinge knuckles and body hinge knuckles, each of the light source support wings comprising at least one light module, each of the light modules comprising at least one light emitting diode arranged therein; wherein each of the light source support wings has an overall hexagonal shape; wherein the light source support wings are arranged such that, when the respective light source support wings are extended in the same plane from the main body, the light source support wings form an overall octagonal shape.

In another aspect of the invention, each of the light source support wings comprises at least one the light emitting device. In another aspect of the invention the light emitting devices is an LED. In another aspect of the invention, each of the light source support wings includes an array of light emitting devices.

In another aspect of the invention, each of the light source support wings includes a light source housing within which the light emitting devices are disposed.

In another aspect of the invention, each of the light source housings comprises a window disposed over the light emitting devices. The window may be transparent or translucent. The window may be made of glass or plastic.

In another aspect of the invention, the light source support wings are provided with articulation grips for conveniently grasping and articulating the light source support wings.

In another aspect of the invention, each of the light source housings is hexagonal in shape.

In another aspect of the invention, each of the light source housings is circular in shape.

In another aspect of the invention, each of the light source housings is octagonal in shape.

In another aspect of the invention, each of the light source housings is four-sided.

In another aspect of the invention, each of the light source housings is triangular.

In another aspect of the invention, each of the light source support wings is configured to rotate in a range of 0 to 360 degrees relative to the main body.

In another aspect of the invention, each of the light source support wings is configured to rotate in a range of 0 to 270 degrees relative to the main body.

In another aspect of the invention, each of the light source support wings is configured to rotate in a range of 0 to 180 degrees relative to the main body.

In another aspect of the invention, each of the light source support wings is configured to rotate in a range of 0 to 90 degrees relative to the main body.

In another aspect of the invention, each of the light source support wings is configured to rotate in a range of 0 to 45 degrees relative to the main body.

In another aspect of the invention, each of the light source support wings is circular in shape.

In another aspect of the invention, each of the light source support wings is octagonal in shape.

In another aspect of the invention, each of the light source support wings is four-sided.

In another aspect of the invention, each of the light source support wings is triangular.

In another aspect of the invention, when the respective light source support wings are extended in the same plane from the main body, the light source support wings form an overall circular shape.

In another aspect of the invention, when the respective light source support wings are extended in the same plane from the main body, the light source support wings form a four-sided shape.

In another aspect of the invention, when the respective light source support wings are extended in the same plane from the main body, the light source support wings form triangular shape.

It is within the scope of the invention for each of the light source support wings to be of any known geometric shape.

It is within the scope of the invention that when the respective light source support wings are extended in the same plane from the main body, the light source support wings form any known geometric shape.

It is within the scope of the invention for the main body to have any number of sides.

It is within the scope of the invention for the main body to be three-sided.

It is within the scope of the invention for the main body to be four-sided.

It is within the scope of the invention for the main body to be five-sided.

It is within the scope of the invention for the main body to be six-sided.

It is within the scope of the invention for the main body to be cylindrical.

It is within the scope of the invention for the main body to be of any known geometric shape.

BRIEF DESCRIPTION OF THE DRAWINGS

The invention description below refers to the accompanying drawings, of which.

DETAILED DESCRIPTION OF THE INVENTION

Figure 1:
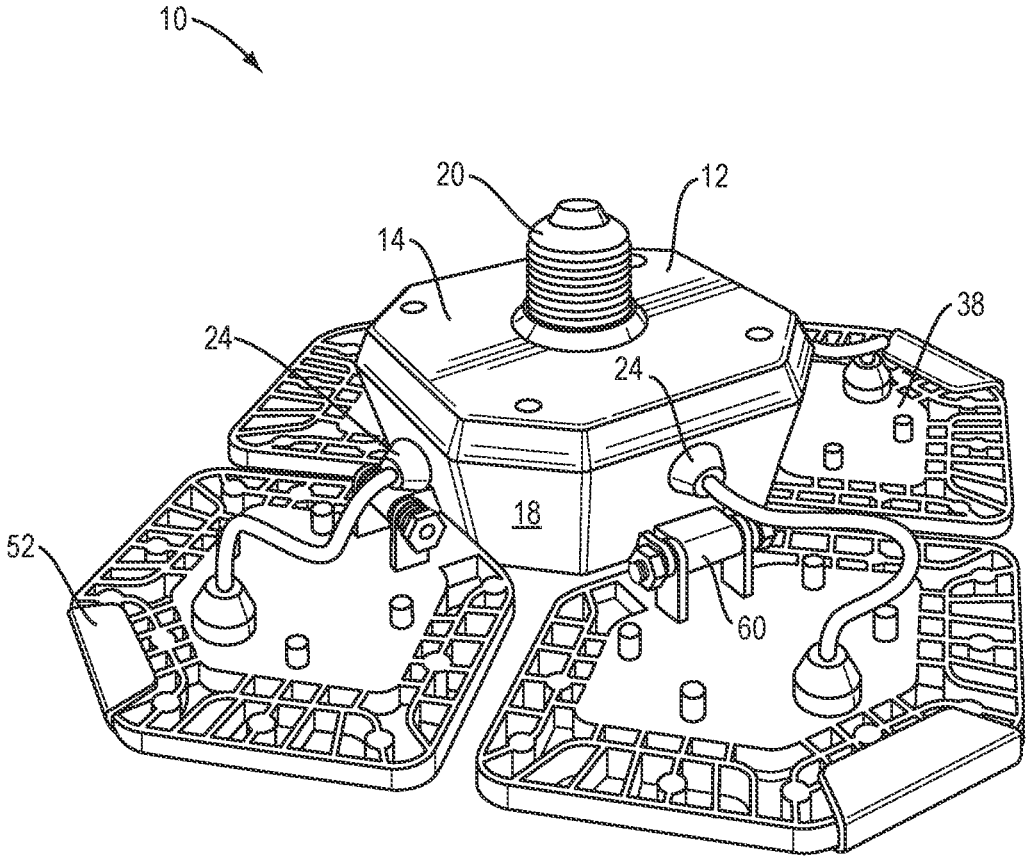
FIG. 1 is a top perspective view of the illumination apparatus according to the present invention, with the four light source wings being aligned.
Figure 2:
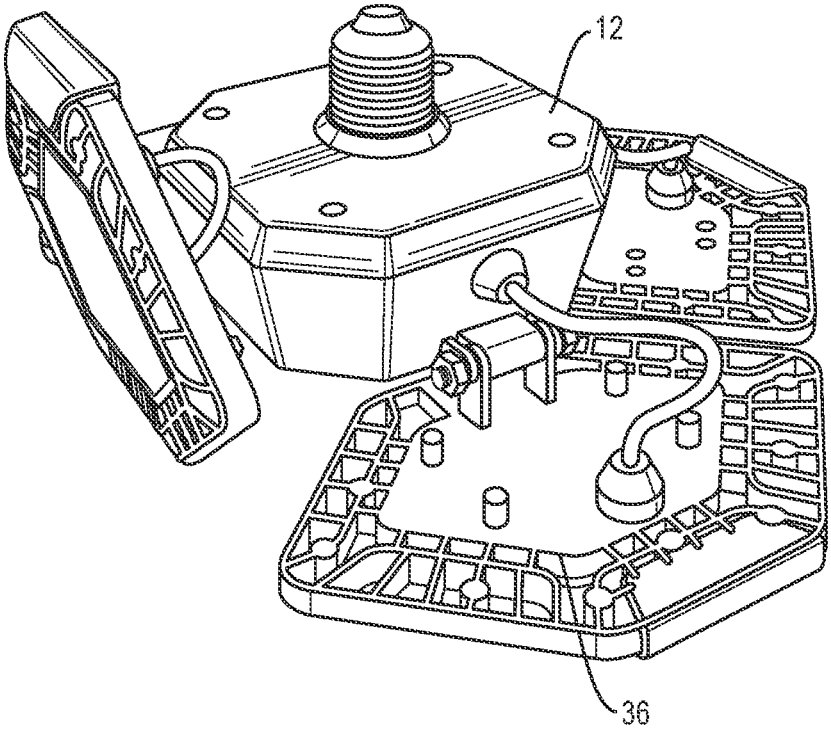
FIG. 2 is a perspective view of the illumination apparatus of FIG. 1, with one light source support wing being oriented upward.
Figure 3:
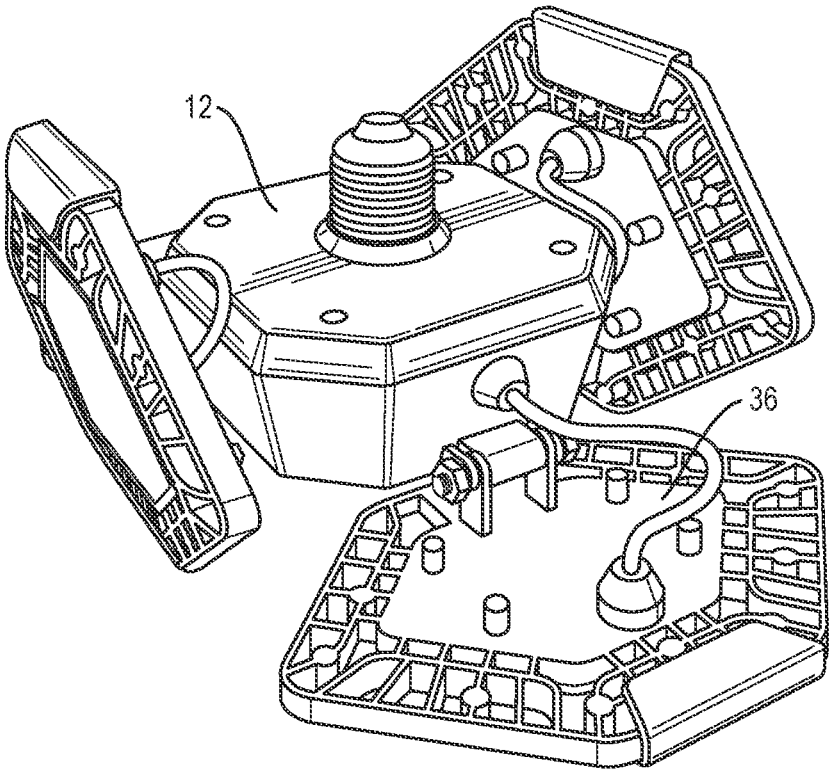
FIG. 3 is a perspective view of the illumination apparatus of FIG. 1, with two light source support wings being oriented upward.
Figure 4:
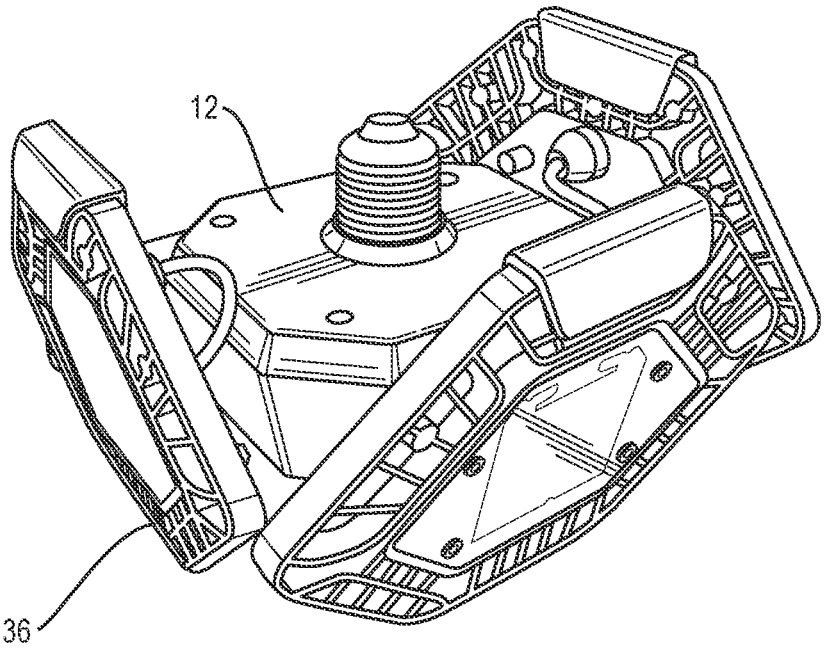
FIG. 4 is a perspective view of the illumination apparatus of FIG. 1, with three light source support wings being oriented upward.
Figure 5:
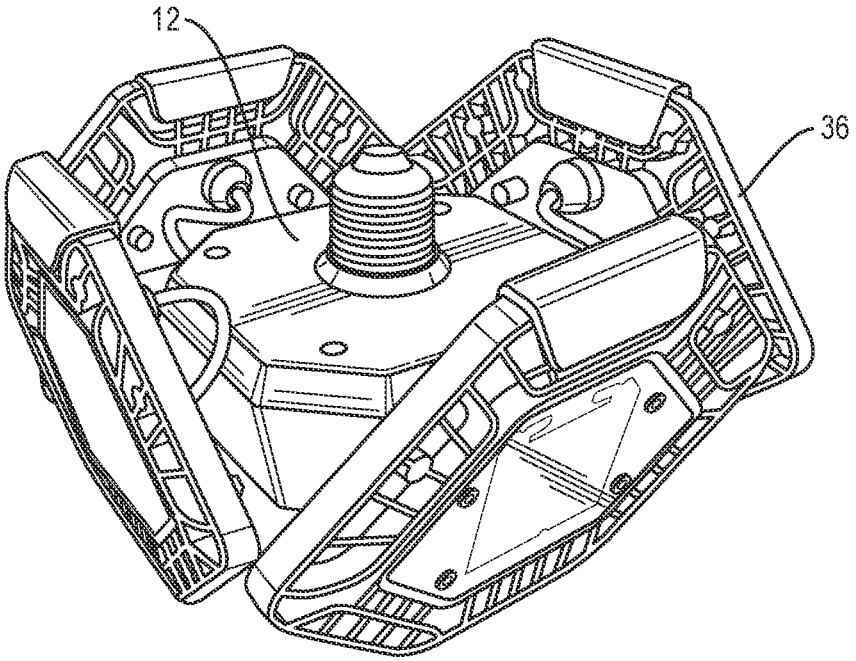
FIG. 5 is a perspective view of the illumination apparatus of FIG. 1, with four light source support wings being oriented upward.
Figure 6:
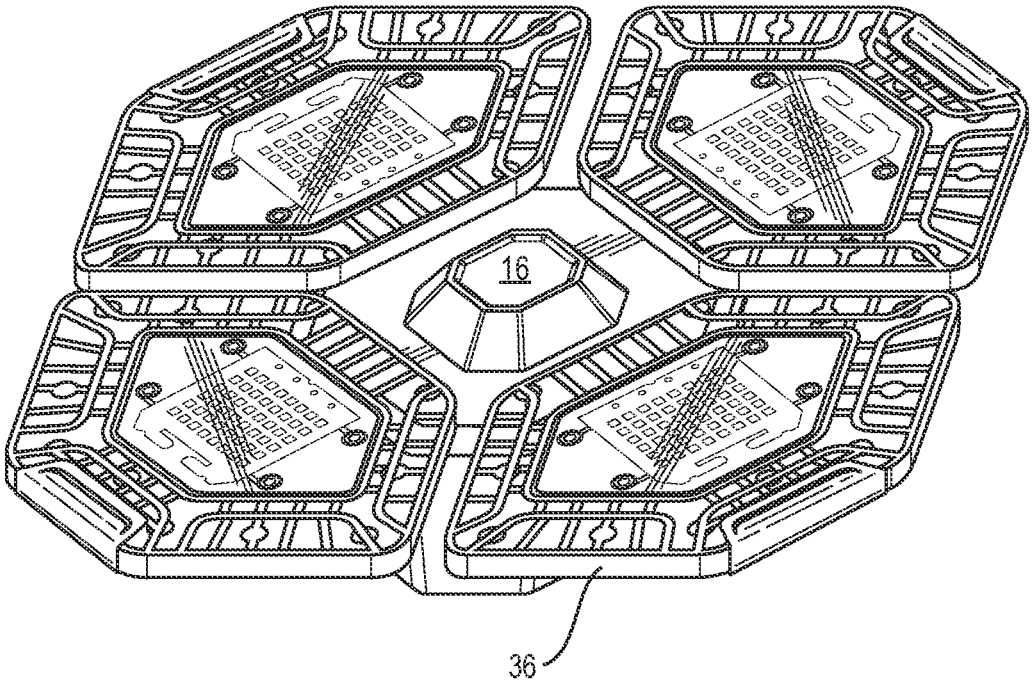
FIG. 6 is a bottom perspective view of an illumination apparatus according to one exemplary embodiment of the present disclosure, with the four light source wings being aligned.
Figure 7:
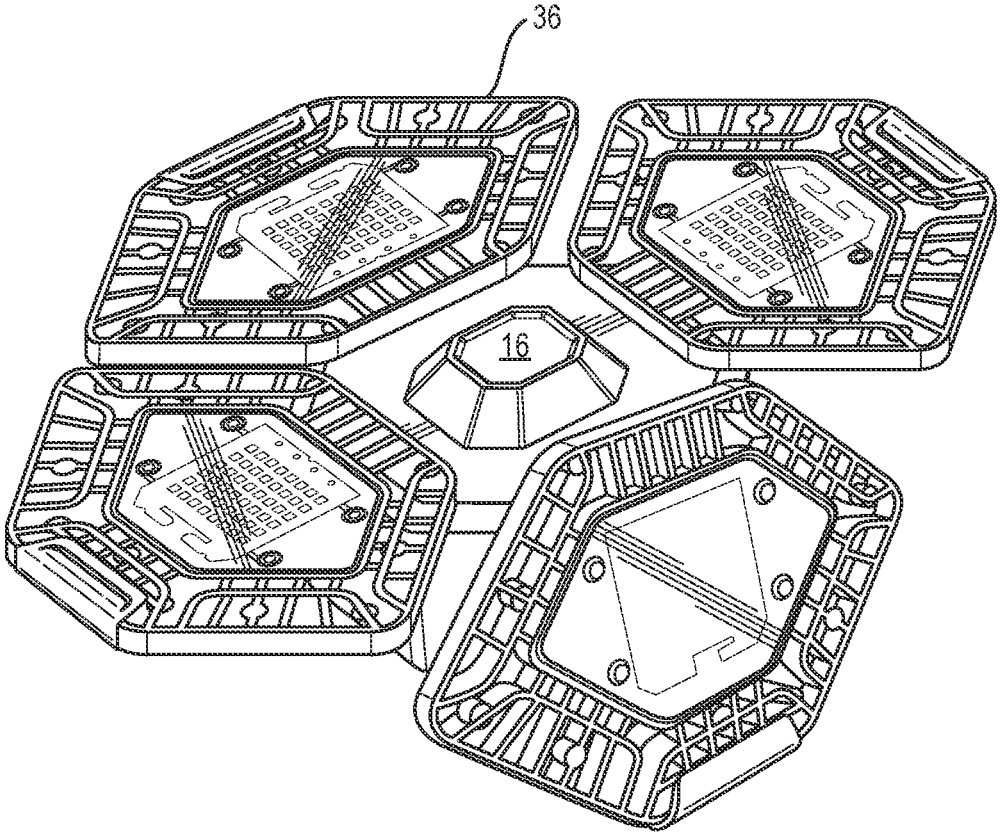
FIG. 7 is a perspective view of the illumination apparatus of FIG. 6, with one light source support wing being oriented upward.
Figure 8:
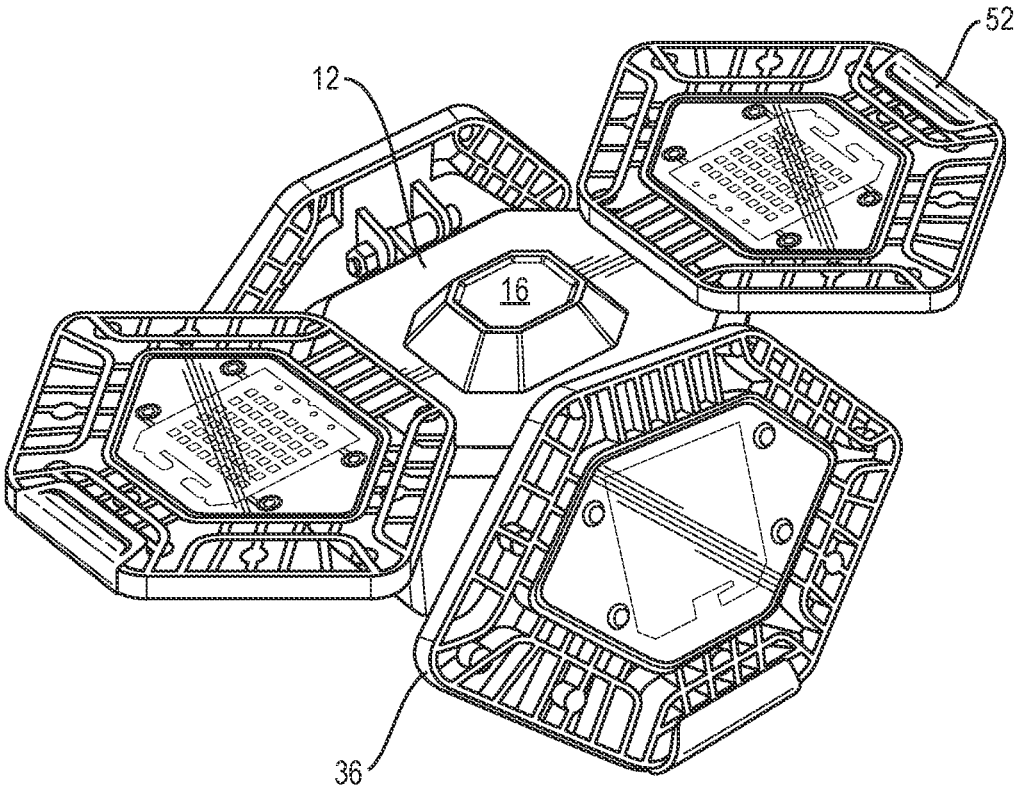
FIG. 8 is a perspective view of the illumination apparatus of FIG. 6, with two light source support wings being oriented upward.
Figure 9:
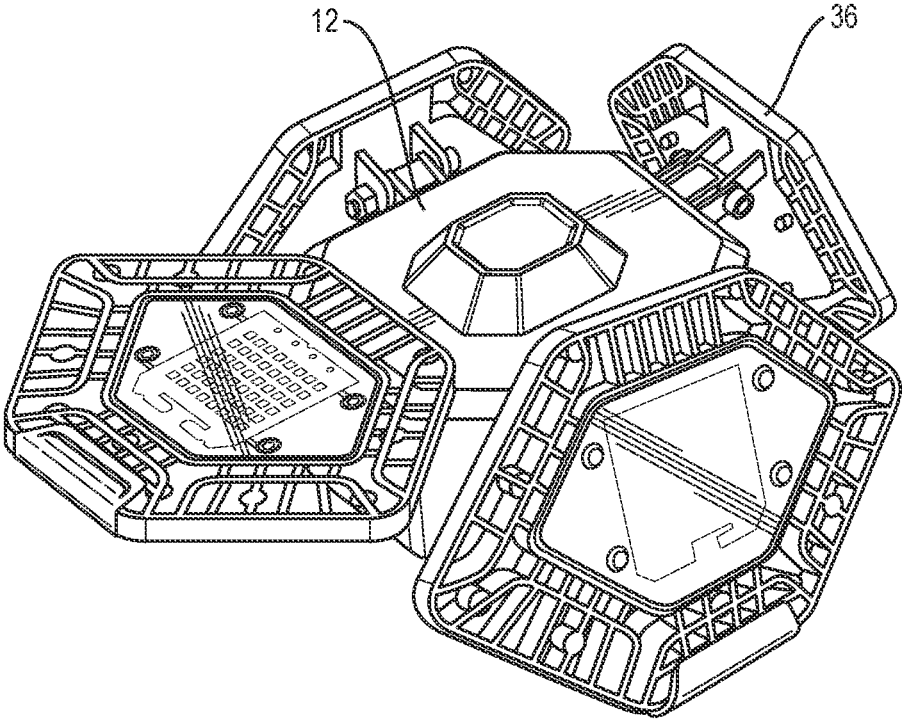
FIG. 9 is a perspective view of the illumination apparatus of FIG. 6, with three light source support wings being oriented upward.
Figure 10:
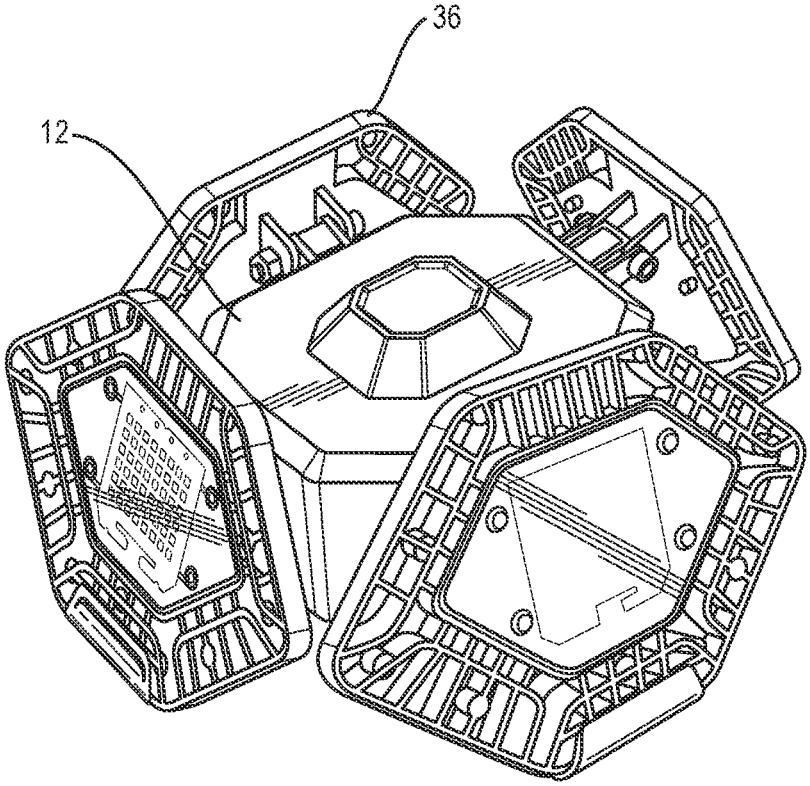
FIG. 10 is a perspective view of the illumination apparatus of FIG. 6, with four light source support wings being oriented upward.
Figure 11:
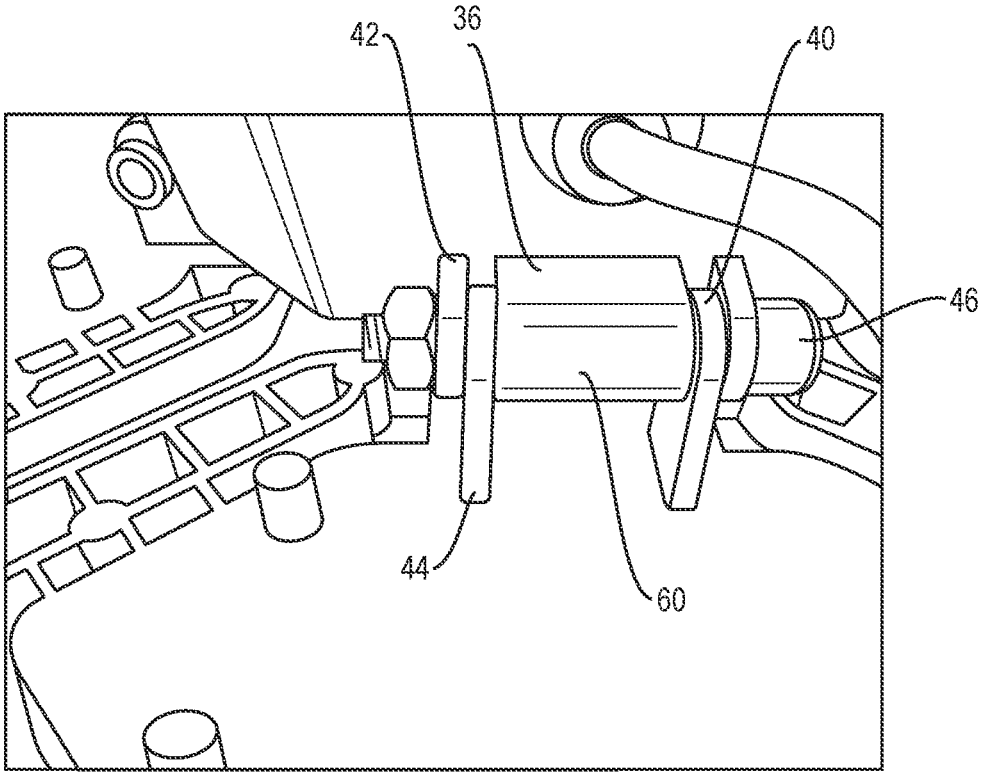
FIG. 11 is a close-up view of a hinge of the illumination apparatus, according to the present invention.
Figure 12:
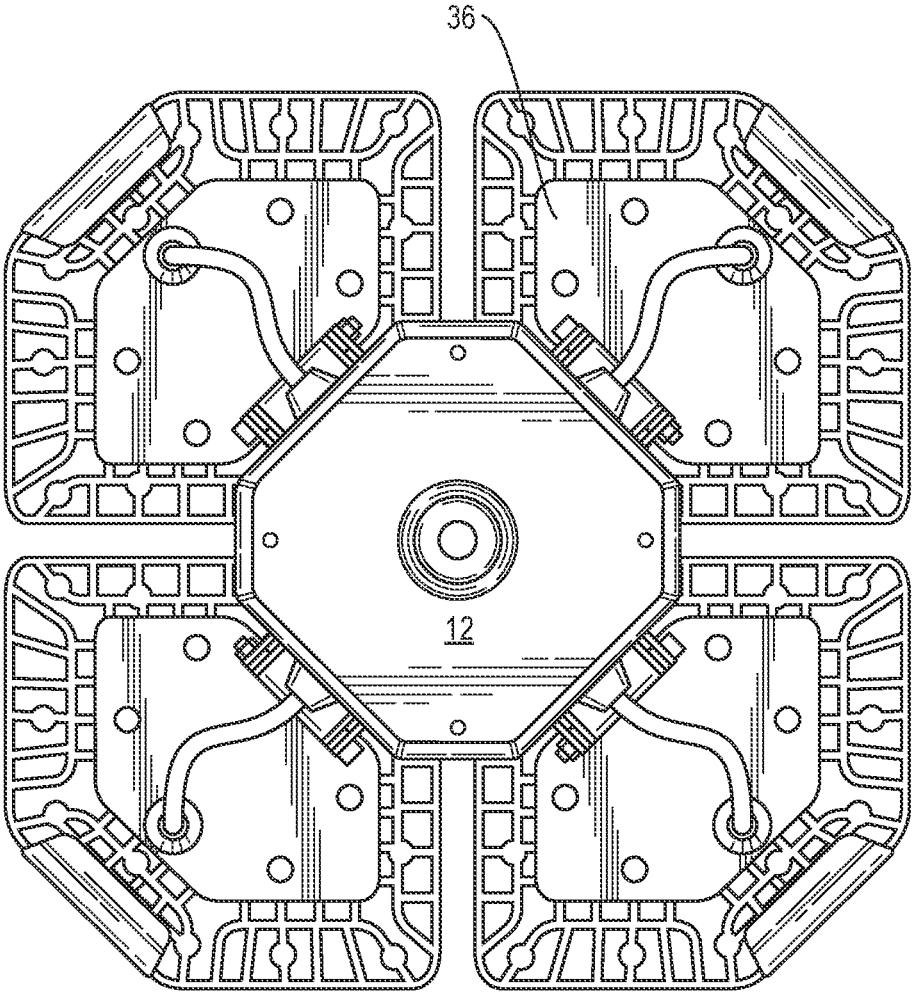
FIG. 12 is a top plan view of the illumination apparatus according to the present invention, with the four light source wings being aligned.
Figure 13:
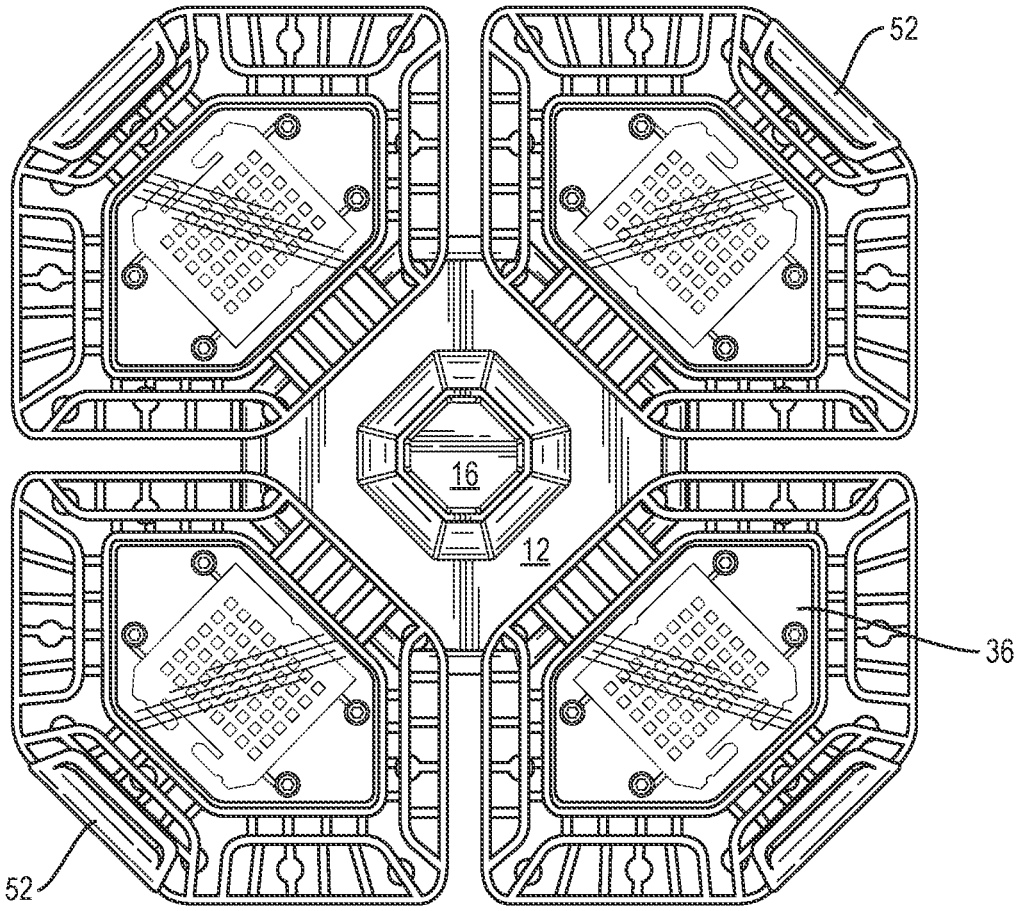
FIG. 13 is a bottom plan view of the illumination apparatus according to the present invention, with the four light source wings being aligned.
Figure 14:
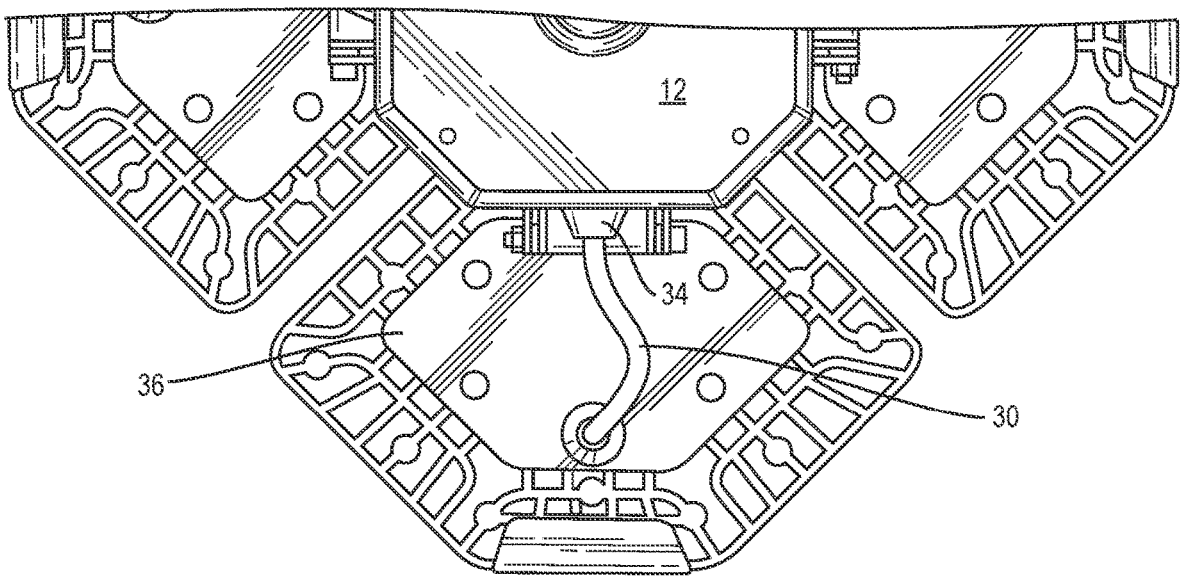
FIG. 14 is a close-up top plan view of a light source support wing.
Figure 15:
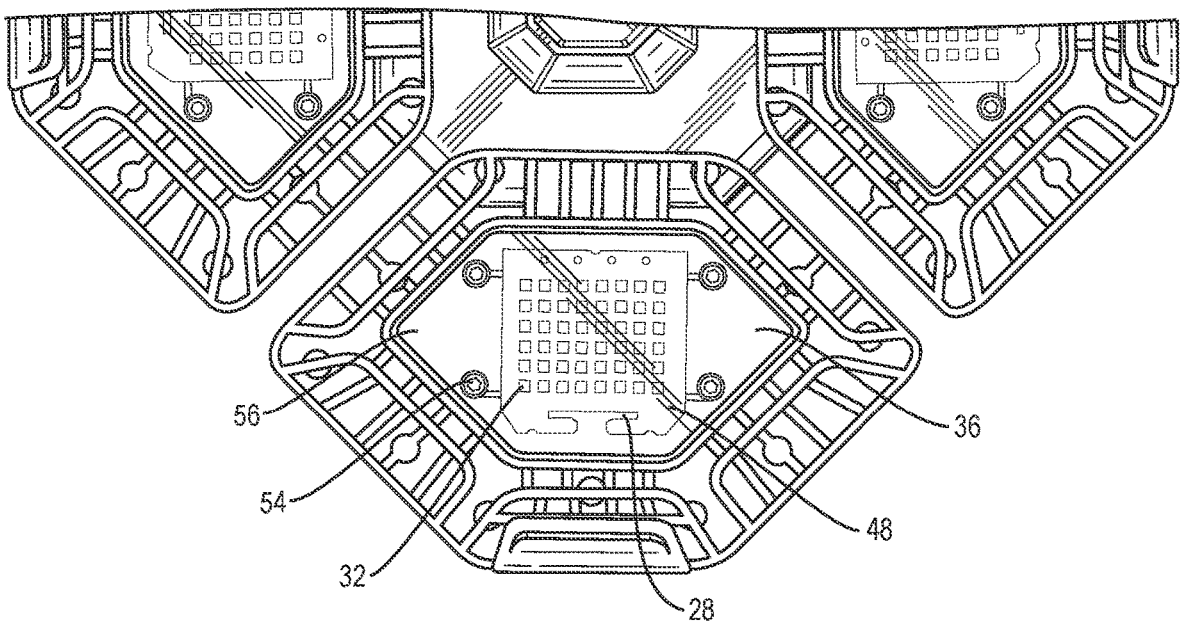
FIG. 15 is a close-up bottom plan view of a light source support wing.
Figure 16:
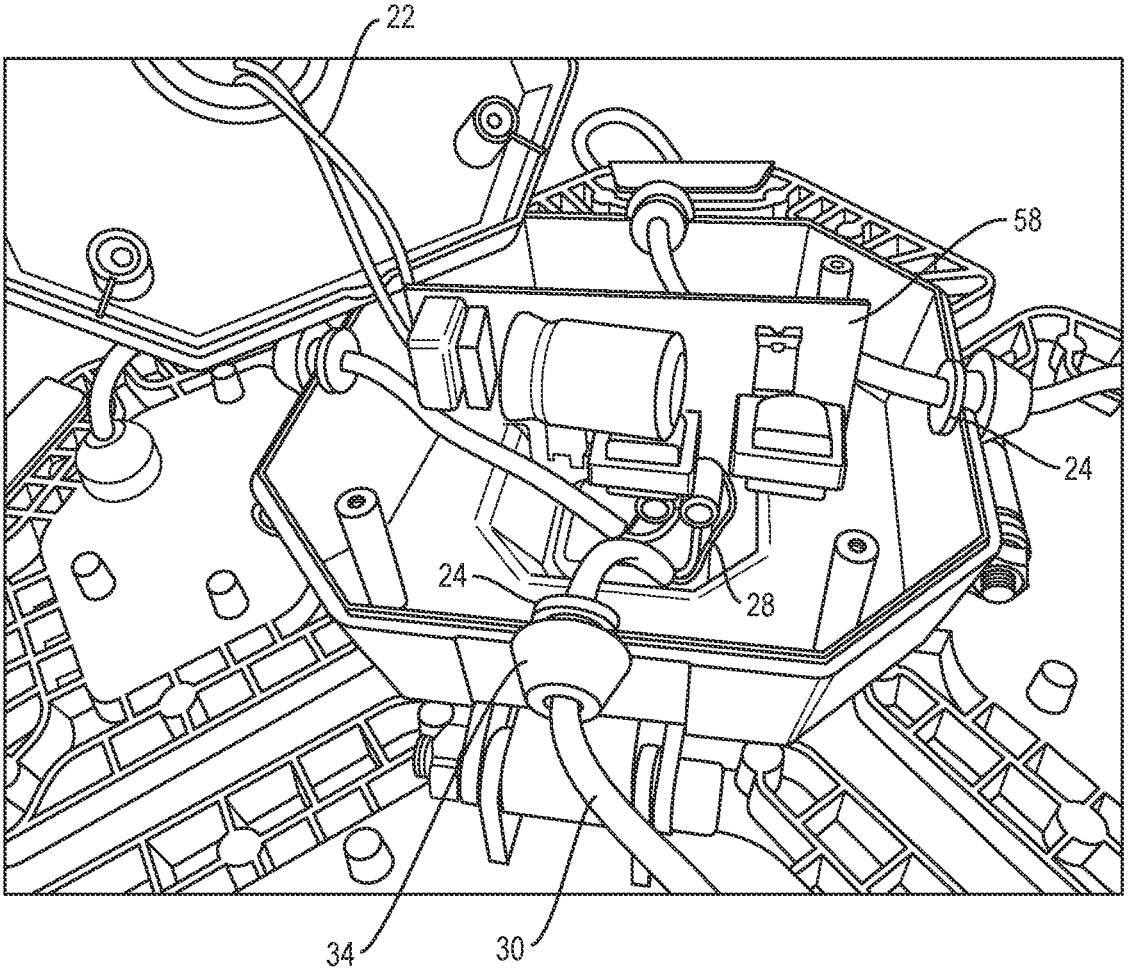
FIG. 16 is a perspective view of the main body, opened to reveal the contents located in the inner space thereof.

Referring to FIGS. 1-16, an illumination apparatus, according to the present invention includes the following features.

The illumination apparatus 10 includes a main body 12 having a top 14, a bottom 16, and sides 18. A socket connection prong 20 protrudes from the top 14 of the main body 12.

The main body 12 defines an inner space for receiving circuitry 58.

The socket connection prong 20 is adapted for communication, for example threaded communication, with an electrical socket (no shown). The socket connection prong 20 is further adapted for electrically communicating with the circuitry disposed within the main body via a wire 22.

The main body 12 is provided with a plurality of wire communicating openings 24 disposed along the perimeter of the main body 12. In a preferred embodiment, the wire communicating openings 24 are equally distanced. In some embodiments, the wire communicating openings 24 are located on every second side 18 of the main body 12. In some embodiments, the wire communicating openings 24 being located on each side 18 of the main body 12.

In one another aspect of the invention, the illumination apparatus 10 includes a plurality of wires 28, each of the plurality of wires 28 passing through a wire insulating sleeve 30, each wire 28 having a first end and a second end, each of the wire insulating sleeves 30 passing through a respective one of the wire communicating openings 24, the first end of each of the plurality of wires 28 being in electrical communication with the circuitry 58, the second end of each of the plurality of wires 28 being in electrical communication with at least one light emitting device 32 via a light emitting device board 48. The wire insulating sleeves 30 may be made of any type of insulator known in the art. The wire insulating sleeves 30 may be made of any type of plastic known in the art, including but not limited to thermoplastic elastomer (TPE), polyvinyl chloride (PVC), semi-rigid pvc (SR-PVC), plenum polyvinyl chloride (Plenum PVC), polyethylene (PE), polypropylene (PP), polyurethane (PUR), chlorinated polyethylene (CPE), or nylon. The wire insulating sleeves 30 may also be made of any type of rubber known in the art, including but not limited to thermoplastic rubber (TPR), neoprene (polychloroprene), styrene butadiene rubber (SBR), silicone, fiberglass, ethylene propylene rubber (EPR), natural rubber, chlorosulfonated polyethylene (CSPE), ethylene propylene diene monomer (EPDM). In preferred embodiments, grommets 34 are provided in the wire communication openings 24, the wire insulating sleeves 30 passing through the grommets 34. The grommets 34 may be made of any type of plastic known in the art, including but not limited to thermoplastic elastomer (TPE), polyvinyl chloride (PVC), semi-rigid pvc (SR-PVC), plenum polyvinyl chloride (Plenum PVC), polyethylene (PE), polypropylene (PP), polyurethane (PUR), chlorinated polyethylene (CPE), or nylon. The grommets 34 may also be made of any type of rubber known in the art, including but not limited to thermoplastic rubber (TPR), neoprene (polychloroprene), styrene butadiene rubber (SBR), silicone, fiberglass, ethylene propylene rubber (EPR), natural rubber, chlorosulfonated polyethylene (CSPE), ethylene propylene diene monomer (EPDM).

Further, a plurality of body hinge portions 36 are disposed around a perimeter of the main body 12, the body hinge portions 36 being equally distanced. In some embodiments, the body hinge portions 36 are located on every second side 18 of the main body 12. In some embodiments, the body hinge portions 36 are located on each side 18 of the main body 12.

The lighting apparatus also includes four light source support wings 38, each of the light source support wings 38 having a wing hinge portion 40 on one end thereof, each of the light source support wings 38 being hingedly connected to the main body 12 by alignment of its wing hinge portion 40 with a respective one of the body hinge portions 36, the respective the body hinge portions 36 each comprising at least one body hinge knuckle 42 which defines an opening and the respective wing hinge portions 40 each comprising at least one wing hinge knuckle 44 which defines an opening, the respective body hinge knuckles 42 and wing hinge knuckles 44 being aligned and alternating, a pin 46 passing through the respective openings defined by the aligned, alternating wing hinge knuckles 42 and body hinge knuckles 44. Thus, the respective associated body hinge portions 36, wing hinge portions 40, and pins 46 cooperate to provide a plurality of illumination device hinges 60.

In a preferred embodiment of the invention each of the light source support wings 38 has an overall hexagonal shape. In such embodiments, the light source support wings 38 are arranged such that, when the respective light source support wings are extended from the main body 12 in the same plane, the light source support wings 38 form an overall octagonal shape.

In certain embodiments, each of the light source support wings 38 includes at least one the light emitting device 32 provided on a light emitting device board 48. In certain embodiments of the invention, the light emitting devices is an LED 32. In certain embodiments each of the light source support wings 38 includes an array of light emitting devices 32.

By way of example only, the number of light emitting devices 32 on each of the light source support wings 38 may be 1 to 48 and arranged in one to six rows.

In another aspect of the invention, each of the light source support wings 38 includes a light source housing 54 within which the light emitting devices are disposed.

In certain embodiments, each of the light source housings 54 comprises a window 56 disposed over the light emitting devices 32. The window 56 may be transparent or translucent. The window 56 may be made of glass or plastic.

In certain embodiments, each of the light source housings 54 is hexagonal in shape.

In certain embodiments, each of the light source housings 54 is circular in shape.

In certain embodiments, each of the light source housings 54 is octagonal in shape.

In certain embodiments, each of the light source housings 54 is four-sided.

In certain embodiments, each of the light source housings 54 is triangular.

It is within the scope of the invention for the light source housings 54 to be of any known geometric shape.

In certain embodiments, each of the light source support wings 38 is configured to rotate in a range of 0 to 360 degrees relative to the main body.

In certain embodiments, each of the light source support wings 38 is configured to rotate in a range of 0 to 270 degrees relative to the main body.

In certain embodiments, each of the light source support wings 38 is configured to rotate in a range of 0 to 180 degrees relative to the main body.

In certain embodiments, each of the light source support wings 38 is configured to rotate in a range of 0 to 90 degrees relative to the main body.

In certain embodiments, each of the light source support wings 38 is configured to rotate in a range of 0 to 45 degrees relative to the main body In certain embodiments, each of the light source support wings 38 is circular in shape.

In certain embodiments, each of the light source support wings 38 is octagonal in shape.

In certain embodiments, each of the light source support wings 38 is four-sided.

In certain embodiments, each of the light source support wings 38 is triangular.

It is within the scope of the invention for each of the light source support wings 38 to be of any known geometric shape.

It is within the scope of the invention for the main body 12 to be of any known geometric shape.

It is within the scope of the invention that when the respective light source support wings 38 are extended in the same plane from the main body 12, the light source support wings form any known geometric shape.

The main body 12 may be made of any type of plastic known in the art, including but not limited to thermoplastic elastomer (TPE), polyvinyl chloride (PVC), semi-rigid pvc (SR-PVC), plenum polyvinyl chloride (Plenum PVC), polyethylene (PE), polypropylene (PP), polyurethane (PUR), chlorinated polyethylene (CPE), or nylon. The main body 12 may also be made of any type of rubber known in the art, including but not limited to thermoplastic rubber (TPR), neoprene (polychloroprene), styrene butadiene rubber (SBR), silicone, fiberglass, ethylene propylene rubber (EPR), natural rubber, chlorosulfonated polyethylene (CSPE), ethylene propylene diene monomer (EPDM).

The light source support wings 38 are provided with articulation grips 52. The articulation grips 52 may be made of any type of plastic known in the art, including but not limited to thermoplastic elastomer (TPE), polyvinyl chloride (PVC), semi-rigid pvc (SR-PVC), plenum polyvinyl chloride (Plenum PVC), polyethylene (PE), polypropylene (PP), polyurethane (PUR), chlorinated polyethylene (CPE), or nylon. The articulation grips 52 may also be made of any type of rubber known in the art, including but not limited to thermoplastic rubber (TPR), neoprene (polychloroprene), styrene butadiene rubber (SBR), silicone, fiberglass, ethylene propylene rubber (EPR), natural rubber, chlorosulfonated polyethylene (CSPE), ethylene propylene diene monomer (EPDM).

The illumination device hinges 60 permit rotation of the light source support wings 38 with respect to the main body 12. In some embodiments, the light source support wings 38 may not rotate freely and have limited maximum rotational angle. The illumination angle of the light generated by the light emitting devices 32 located on a particular light source support wing 38 may be changed by rotating the light particular light source support wing 38.

The illumination device hinges 60 permit rotation of any one of the light source support wings 38 with respect to the main body 12 independent of the rotation, position or orientation of the other the light source support wings 38.

For example, all of the light source support wings 38 may be oriented straight out from the main body so that all the light from the apparatus 10 is directed to the floor or work surface.

Alternatively, two the light source support wings 38 may be rotated upward, for example, 90 degrees, so as to direct the light emitted from the light emitting devices 32 towards respective two side walls to obtain direct illumination thereon.

Alternatively, three the light source support wings 38 may be rotated upward, for example, 90 degrees, so as to direct the light emitted from the light emitting devices 32 towards three respective side walls to obtain direct illumination thereon.

Alternatively, one the light source support wings 38 may be rotated upward, for example, 90 degrees, so as to direct the light emitted from the light emitting devices 32 towards one respective side wall to obtain direct illumination thereon.

Thus, depending on its intended use, the present illumination device 10 may be adjusted to alter the illumination angle and/or to direct the emitted light towards a ceiling, a wall, or an object for direct illumination.

The light source support wings 38 according to the present invention act as heat dissipation devices and are preferably made of metal. In exemplary embodiments, they are made of cast aluminum alloy. However, it is within the scope of the invention for them to be made of any known heat dissipation material, including steel, copper, aluminum, or magnesium, or of ceramic, or alloy thereof. The light source support wings 38 dissipate the heat generated from the operation of the light emitting devices 32. The light source support wings 38 are also provided with perforations or openings for more effective and efficient dissipation of heat. In certain embodiments, the light source support wings 38 are provided with articulation grips 52 for facilitating convenient and safe grasping and articulation of the light source support wings 38.

It is understood that the invention may be embodied in other forms without departing from the spirit thereof. Thus, the present examples and embodiments are to be considered in all respects as illustrative and not restrictive, and the invention is not to be limited to the details given herein.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A lighting apparatus, comprising:

a main body containing electric circuitry;

a plurality of light source support wings, each of the light source support wings being hingedly attached to the main body about a perimeter of the main body and supporting at least one LED;

a plurality of wire communicating openings disposed along the perimeter of the main body; and a plurality of wires, each of the plurality of wires associated with a respective one of the light source support wings and electrically connecting the electric circuitry to at least one LED disposed on the respective one of the light source support wings, each of the plurality of wires passing through a respective wire insulating sleeve, the respective wire insulating sleeve passing through a respective one of the plurality of wire communicating openings;

wherein each of the light source support wings is configured to rotate relative to the main body independent of the other light source support wings.

2. The lighting apparatus of claim 1 further comprising:

a plurality of body hinge portions disposed around a perimeter of the main body, the body hinge portions being equally distanced; and wherein each of the light source support wings has a wing hinge portion on one end thereof, each of the light source support wings being hingedly connected to the main body by alignment of its wing hinge portion with a respective one of the body hinge portions, the respective body hinge portions each comprising at least one body hinge knuckle which defines an opening and the respective wing hinge portions each comprising at least one wing hinge knuckle which defines an opening, the respective body hinge knuckles and wing hinge knuckles being aligned and alternating, a pin passing through the respective openings defined by the aligned, alternating wing hinge knuckles and body hinge knuckle.

3. A lighting apparatus, comprising:

a main body containing electric circuitry;

a plurality of light source support wings, each of the light source support wings being hingedly attached to the main body about a perimeter of the main body and supporting at least one LED;

a plurality of wire communicating openings disposed along the perimeter of the main body; and a plurality of wires, each of the plurality of wires associated with a respective one of the light source support wings and electrically connecting the electric circuitry to at least one LED disposed on the respective one of the light source support wings, each of the plurality of wires passing through a respective wire insulating sleeve, the respective wire insulating sleeve passing through a respective one of the plurality of wire communicating openings, wherein each of the light source support wings has an overall hexagonal shape.

4. A lighting apparatus, comprising:

a main body containing electric circuitry;

a plurality of light source support wings, each of the light source support wings being hingedly attached to the main body about a perimeter of the main body and supporting at least one LED;

a plurality of wire communicating openings disposed along the perimeter of the main body; and a plurality of wires, each of the plurality of wires associated with a respective one of the light source support wings and electrically connecting the electric circuitry to at least one LED disposed on the respective one of the light source support wings, each of the plurality of wires passing through a respective wire insulating sleeve, the respective wire insulating sleeve passing through a respective one of the plurality of wire communicating openings, wherein the light source support wings are arranged such that, when the respective light source support wings are extended in the same plane from the main body, the light source support wings form an overall octagonal shape.

5. The lighting apparatus of claim 1 wherein each of the light source support wings is configured to rotate in a range of 0 to 270 degrees relative the main body.

6. The lighting apparatus of claim 1 wherein each of the light source support wings is configured to rotate in a range of 0 to 180 degrees relative the main body.

7. The lighting apparatus of claim 1 wherein each of the light source support wings is configured to rotate in a range of 0 to 90 degrees relative the main body.

8. The lighting apparatus of claim 1 wherein each of the light source support wings is configured to rotate in a range of 0 to 45 degrees relative the main body.

9. The lighting apparatus of claim 1 wherein the light source support wings are provided with articulation grips adapted for facilitating grasping and articulation of the light source support wings.

10. The lighting apparatus according to claim 1, further comprising a plurality of grommets provided in the wire communication openings, the wire insulating sleeves passing through the grommets.

* * * * *